US008435137B2

(12) United States Patent
Hirano

(10) Patent No.: US 8,435,137 B2
(45) Date of Patent: May 7, 2013

(54) GOLF CLUB HEAD

(75) Inventor: Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 408 days.

(21) Appl. No.: 12/787,899

(22) Filed: May 26, 2010

(65) Prior Publication Data

US 2010/0304888 A1 Dec. 2, 2010

(30) Foreign Application Priority Data

May 27, 2009 (JP) ..... 2009-128085

(51) Int. Cl.
*A63B 53/04* (2006.01)

(52) U.S. Cl.
USPC ..... 473/345; 473/349

(58) Field of Classification Search ..... 473/345–349
See application file for complete search history.

(56) References Cited

U.S. PATENT DOCUMENTS

| | | | | |
|---|---|---|---|---|
| 7,156,750 | B2 * | 1/2007 | Nishitani et al. | 473/329 |
| 7,166,038 | B2 * | 1/2007 | Williams et al. | 473/329 |
| 7,717,806 | B2 * | 5/2010 | Kubota | 473/340 |
| 2006/0019766 | A1 * | 1/2006 | Kubota | 473/340 |
| 2009/0270199 | A1 * | 10/2009 | Chen | 473/348 |

FOREIGN PATENT DOCUMENTS

JP 7-155410 A 6/1995

* cited by examiner

*Primary Examiner* — Stephen L. Blau
(74) *Attorney, Agent, or Firm* — Birch, Stewart, Kolasch & Birch, LLP

(57) ABSTRACT

A hollow golf club head is disclosed, wherein a front member including a face portion and a hosel portion of the club head is made of a material having a specific gravity ρ1; a rear member forming a backmost point of the club head is made of a material having a specific gravity ρ2; and an intermediate member extending annularly through in a crown portion, a sole portion and a sidewall portion of the head is made of a material having a specific gravity ρ3; and the specific gravity ρ3 is more than the specific gravity ρ1 which is more than the specific gravity ρ2.

16 Claims, 6 Drawing Sheets

GOLF CLUB HEAD

BACKGROUND OF THE INVENTION

The present invention relates to a golf club head having a hollow structure composed of at least three parts having different specific gravities.

As well known in the art, to increase the lateral moment of inertia of a golf club head is advantageous to decreasing of variations of golf ball flying directions and traveling distances. Therefore, in order to increase the lateral moment of inertia of the golf club heads, golf club manufacturers have hitherto devoted their efforts to increasing of the head volume.

Recently, however, Golf Rules limit the maximum volume of the golf club heads. As a result, the previous technique to increase the head volume is no longer useful. It is necessary to establish a new way to increase the moment of inertia with the limited head volume.

SUMMARY OF THE INVENTION

It is therefore, an object of the present invention to provide a hollow golf club head which has a hollow structure composed of at least three parts capable of increasing the moment of inertia without exceeding the upper limit of the head volume.

According to the present invention, a golf club head has
a hollow structure comprising
a front member including a face portion and a hosel portion,
a rear member forming the backmost point B of the club head, and
an annular intermediate member therebetween,
the front member made of a material having a specific gravity $\rho 1$, the intermediate member made of a material having a specific gravity $\rho 2$, and the rear member made of a material having a specific gravity $\rho 3$, wherein
the specific gravity $\rho 3$ is more than the specific gravity $\rho 1$ which is more than the specific gravity $\rho 2$.

Therefore, within the limited range of the head volume, by increasing the size of the intermediate member having the smallest specific gravity, it becomes possible to increase the mass of the front member and/or the mass of the rear member so as to increase the moment of inertia.

Since the specific gravity $\rho 3$ of the rear member is larger than the specific gravity $\rho 1$ of the front member, the rear member can be formed in a smaller size than the front member without losing a good weight balance between the front and rear of the head. Further, it is also possible to deepen the center of gravity of the head.

In this application (including the description and claims):

Various dimensions, sizes, positions, directions and the like relating to the club head refer to those under a standard state of the club head unless otherwise noted;

The standard state of the club head is such that the club head is set on a horizontal plane HP so that the club face angle becomes zero, and the center line CL of the club shaft (not shown) is inclined at its lie angle while keeping the club shaft center line CL on a vertical plane VP1, and the club face 2 forms its loft angle θ with respect to the horizontal plane HP. Incidentally, in the case of the club head alone, the center line of the shaft inserting hole (7*a*) can be used instead of the center line of the club shaft;

Lateral moment of inertia M1 is the moment of inertia around a vertical axis passing through the center of gravity G in the standard state;

Vertical moment of inertia M2 is the moment of inertia around a horizontal axis passing through the center of gravity G in the heel-and-toe direction of the head in the standard state.

Sweet spot SS is the point of intersection between the club face and a straight line N drawn normally to the club face passing the center of gravity G of the head;

Front-back direction Y is a direction parallel with the above-mentioned straight line N projected on the horizontal plane HP;

Heel-and-toe direction X is a direction parallel with the horizontal plane HP and perpendicular to the front-back direction Y;

The term "wood-type golf club head" means a club head for a driver (#1 wood), fairway woods (including at least #2-#5 woods) and utility woods whose head shapes are similar to those of the fairway woods;

various heights refers to those measured from the horizontal plane HP under the standard state unless otherwise noted.

BRIEF DESCRIPTION OF THE DRAWINGS

FIG. 4(*b*) is a side view of the golf club head from its heel-side.

DESCRIPTION OF THE PREFERRED EMBODIMENTS

Figure 1:
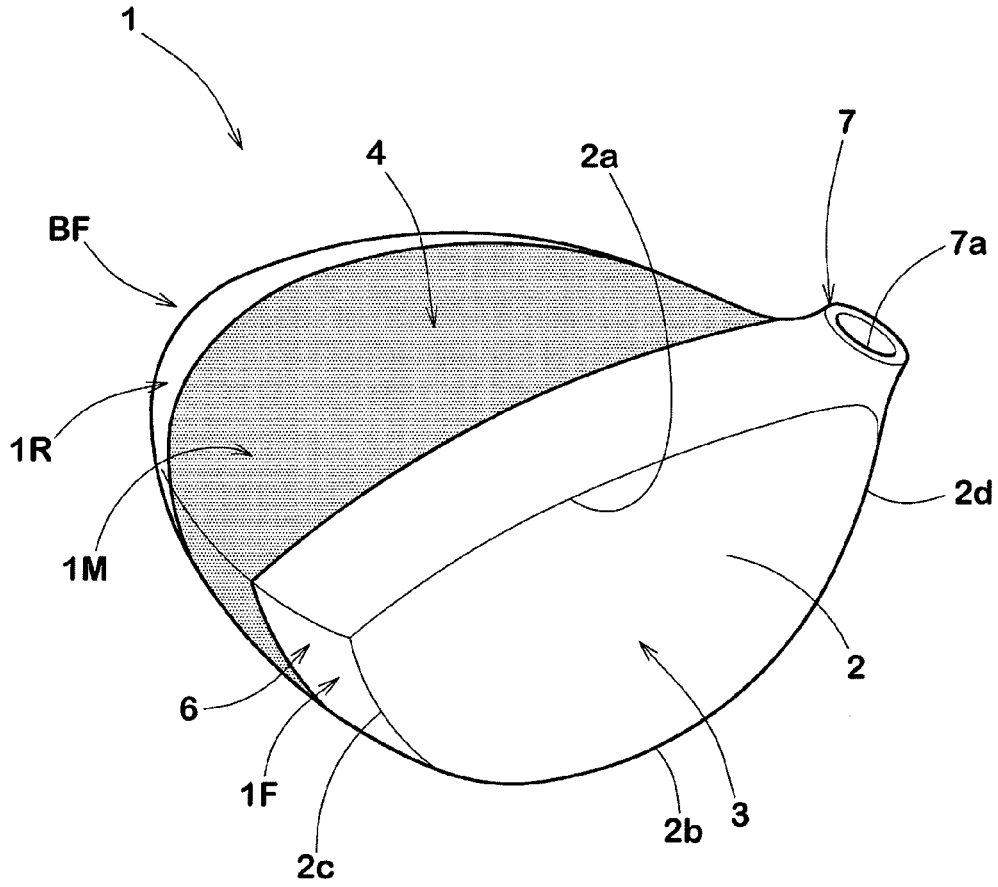
FIG. 1 is a perspective view of a golf club head according to the present invention.

Embodiments of present invention will now be described in detail in conjunction with accompanying drawings.

In the drawings, golf club head 1 according to the present invention comprises: a face portion 3 whose front face defines a club face 2 for hitting a ball; a crown portion 4 intersecting the club face 2 at the upper edge 2*a* thereof; a sole portion 5 intersecting the club face 2 at the lower edge 2*b* thereof; a sidewall portion 6 between the crown portion 4 and sole portion 5 which extends from a toe-side edge 2*c* to a heel-side edge 2*d* of the club face 2 through the back face BF of the club head; and a hosel portion 7 at the heel side end of the crown to be attached to an end of a club shaft (not shown) inserted into the shaft inserting hole 7*a*.

Thus, the club head 1 is provided with a hollow shell structure with the thin wall.

The golf club head 1 is a wood-type golf club head, in this embodiment, a head for a driver (#1 wood).

The loft angle θ of the club head 1 is preferably set in a range of not less than 8.0 degrees, more preferably not less than 8.5 degrees, still more preferably not less than 9.0 degrees, but not more than 17.0 degrees, more preferably not more than 16.5 degrees, still more preferably not more than 16.0 degrees.

If the loft angle θ is less than 8.0 degrees, the ball launching angle and carry distance are decreased, and there is a tendency that the variation of the traveling distance (carry+run) increases. If the loft angle θ is more than 17.0 degrees, there is a tendency that the backspin increases and the traveling distance is decreased.

The volume of the club head 1 in this embodiment is preferably not less than 400 cc, more preferably not less than 425 cc, still more preferably not less than 450 cc, but not more than 470 cc, more preferably not more than 460 cc.

Such a large head volume can bring a sense of ease to the user at address, and increase the moment of inertia and the depth of the center of gravity. This helps to improve the carry distance and directional stability of the ball.

However, if the head volume is too large, the mass of the club head increases and the swing balance is liable to be deteriorated.

The mass of the club head 1 is preferably not less than 175 g, more preferably not less than 180 g, still more preferably not less than 185 g, but not more than 210 g, more preferably not more than 205 g in view of the swing balance.

According to the invention, the club head 1 is composed of a front member 1F, a rear member 1R, and an intermediate member 1M therebetween.

Front Member 1F

Figure 5:
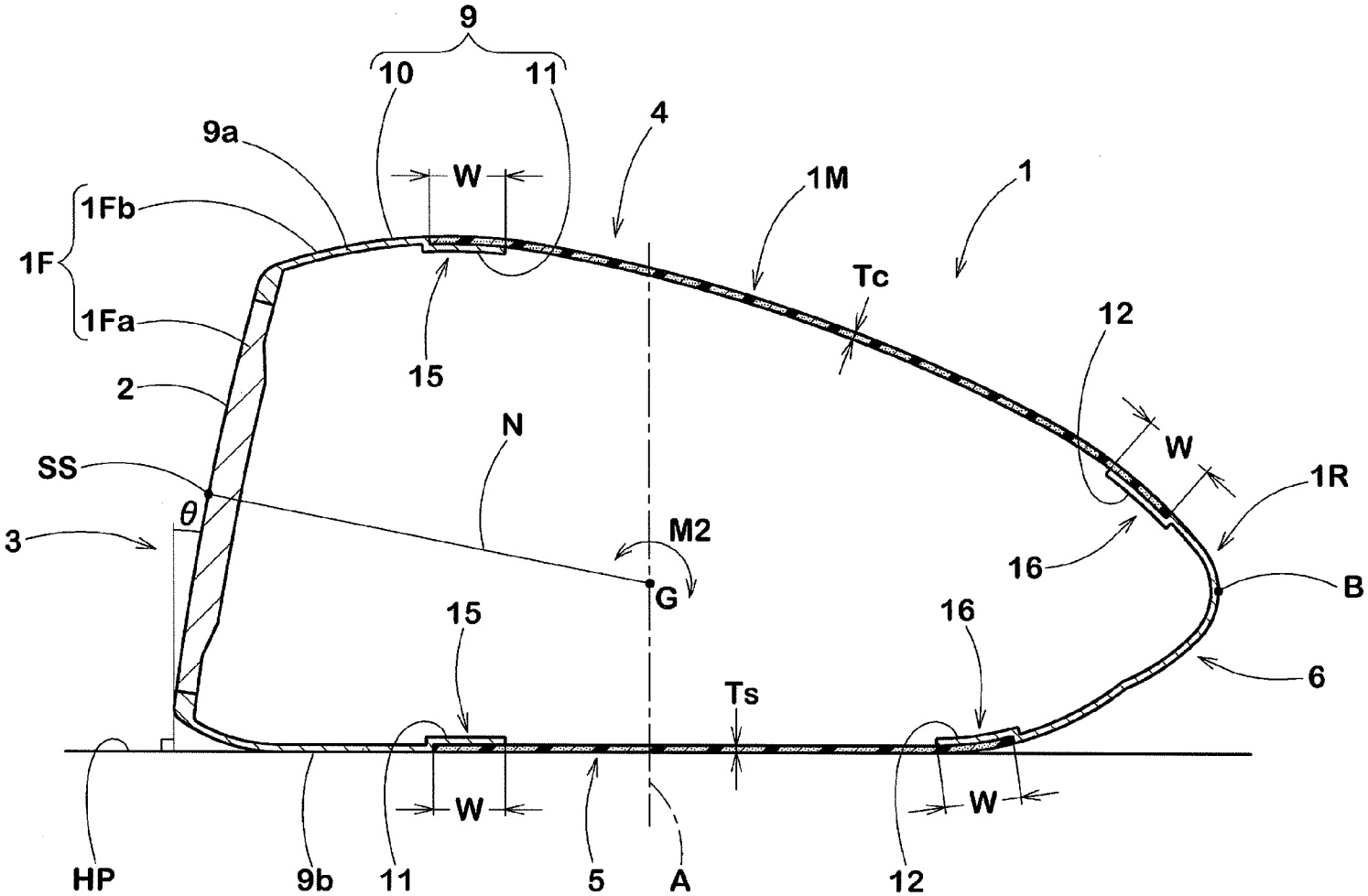
FIG. 5 is a cross sectional view taken along line A-A of FIG. 2.
Figure 6:
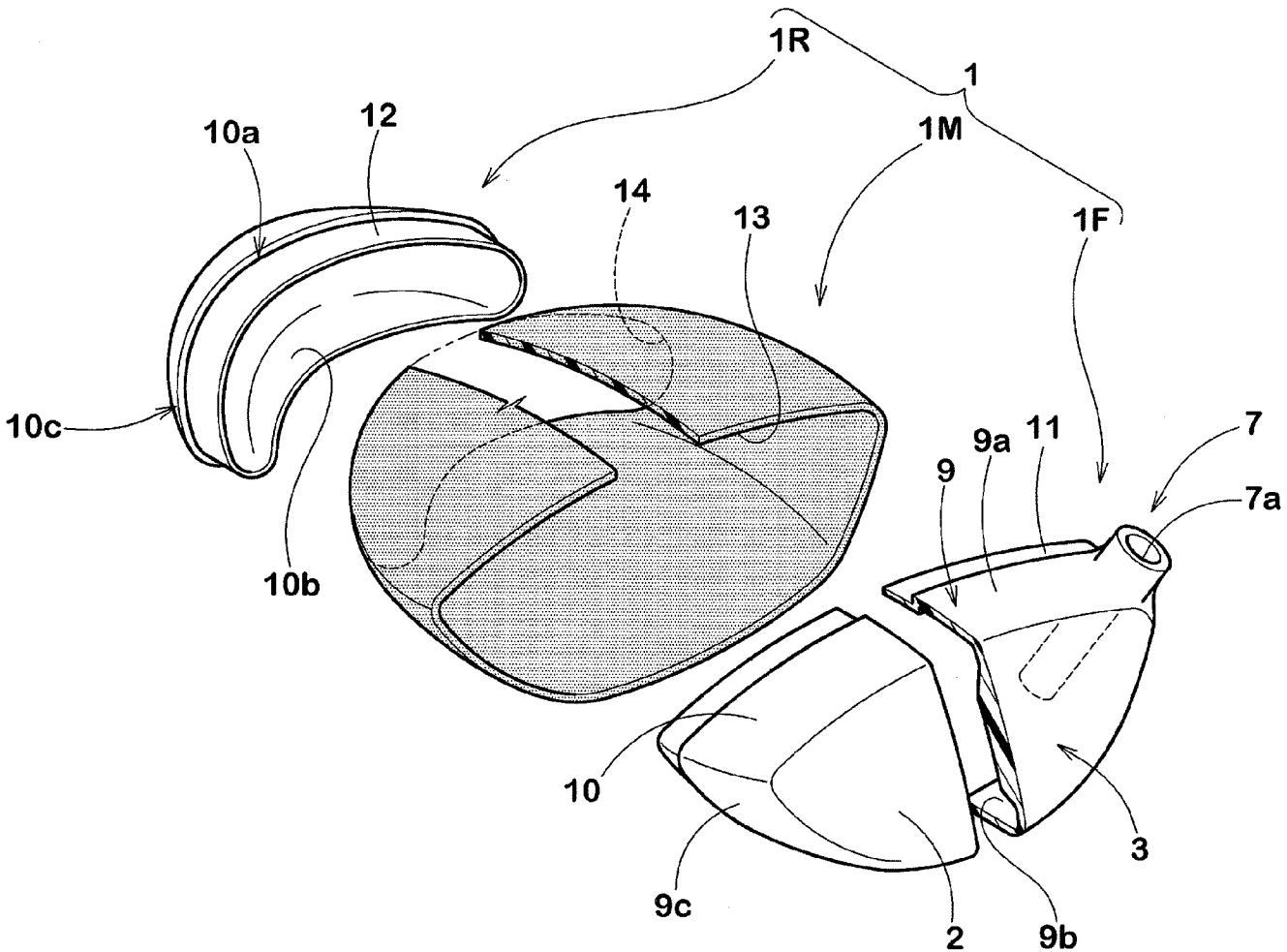
FIG. 6 is an exploded perspective view of the golf club head.

The front member 1F includes the face portion 3 and hosel portion 7 as shown in FIGS. 5 and 6.

In this example, the front member 1F further includes a turnback 9. The turnback 9 extends backwardly of the club head from at least a part (in this example the entirety) of the peripheral edge of the face portion 3.

The turnback 9 in this example is made up of a crown turnback 9*a* forming a front part of the crown portion 4, a sole turnback 9*b* forming a front part of the sole portion 5, a toe-side turnback 9*c* forming a toe-side front part of the sidewall portion 6, and a heel-side turnback 9*d* forming a heel-side front part of the sidewall portion 6, which extend continuously annularly along the peripheral edge of the face portion 3.

In this example, the turnback 9 is provided with an inside overlapping part 11.

In other words, the turnback 9 is made up of a turnback main portion 10 continued from the face portion 3 and forming a part of the outer surface of the club head, and the inside overlapping part 11 extending backward from the turnback main portion 10 and having an outer surface which steps down towards the inside of the head from that of the turnback main portion 10.

The inside overlapping part 11 in this example is formed continuously along the entire length of the rear edge of the front member 1F with a positive width (backward extension). It is however also possible to form the inside overlapping part 11 discontinuously along the length of the rear edge of the front member 1F.

The front member 1F can be formed by integral molding or assembling a plurality of parts.

When assembling a plurality of parts, it is preferable that, as shown in FIG. 5, the front member 1F is made up of an annular frame 1Fb integrally including the hosel portion 7 and turnback 9, and a face plate 1Fa attached to the front of the annular frame 1Fb so as to close the front opening of the annular frame 1Fb.

In view of the strength, it is preferable that the face plate 1Fa is formed by plastic forming such as forging and press molding of a rolled material so that the face plate 1Fa has a compact crystalline structure.

on the other hand, in the case of the frame 1Fb having a complicated shape, in view of the production efficiency, it is preferable that the frame 1Fb is formed by casting such as lost-wax precision casting.

Rear Member

The rear member 1R includes the backmost point B of the club head, and extends therefrom towards the club face side for a relatively short distance, thereby having a hollow front-open cup-like shell structure.

Specifically, as shown in FIG. 5, the rear member 1R includes a rear part 10*a* of the crown portion 4, a rear part 10*b* of the sole portion 5, and a rear part 10*c* of the sidewall portion 6. Aside from this arrangement, another arrangement is also possible, for example, such that the rear part 10*c* is omitted or reduced in the size in the front-back direction Y. In other words, the extension of the rear member 1R from the backmost point B towards the club face side can be reduced in the sidewall portion 6 in comparison with other portions.

The rear member 1R is provided with an inside overlapping part 12 similarly to the front member 1F. The inside overlapping part 12 extends along the front edge of the rear member 1R with a positive width, and has an outer surface which steps down toward the inside of the club head from the outer surface of the club head.

In this example, the inside overlapping part 12 is formed continuously along the entire length of the front edge of the rear member 1R. It is however also possible to form the inside overlapping part 12 discontinuously.

Intermediate Member 1M

The intermediate member 1M has an annular structure extending continuously through the crown portion 4, toe-side sidewall portion 6, sole portion 5 and heel-side sidewall portion 6 to thereby have a front opening 13 and a rear opening 14 as shown in FIG. 1 and FIG. 6.

The intermediate member 1M is positioned so as to overlap with the center of gravity G of the head in the plan view of the head. In other words, a vertical line (A) passing through the center of gravity G of the head penetrates the intermediate member 1M only.

In the front opening 13, the above-mentioned inside overlapping part 11 of the front member 1F is fitted, and they are lap-jointed.

In the rear opening 14, the above-mentioned inside overlapping part 12 of the rear member 1R is fitted, and they are lap-jointed.

In order that the outer surface of the intermediate member 1M becomes substantially same levels as the outer surfaces of the front member 1F and rear member 1R, the amount of step down of each of the inside overlapping parts 11 and 12 is set to be substantially same as the thickness of the overlapping part of the intermediate member 1M.

In the outer surface of the club head, the surface area Sm of the intermediate member 1M is set to be larger than the surface area Sf of the front member 1F and larger than the surface area Sr of the rear member 1R in order to obtain a mass margin (a surplus mass which can be used in designing the weight distribution of the club head.

Specifically, the surface area Sm of the intermediate member 1M is set to be not less than 50%, more preferably not less than 60%, but preferably not more than 75%, more preferably not more than 70% of the overall surface area of the club head including the opening area of the shaft inserting hole 7*a*. If the surface area Sm is more than 75%, there is a possibility that the durability of the club head is decreased.

Specific Gravities of Members 1F, 1M and 1R

The specific gravity ρ1 of the front member 1F, the specific gravity ρ2 of the intermediate member 1M and the specific gravity ρ3 of the rear member 1R satisfy the following relationship (1):

$$\rho 3>\rho 1>\rho 2 \quad (1).$$

Therefore, the intermediate member 1M can bring out a large mass margin. By assigning the mass margin to the front member and rear member, the mass of the club head 1 is increased in the front and rear, thus the moment of inertia can be effectively increased without increasing the head volume.

The specific gravity ρ1 of the front member 1F is preferably not less than 3.0, more preferably not less than 4.0, still more preferably not less than 4.5, but not more than 6.0, more preferably not more than 5.0, still more preferably not more than 4.7.

In the case of a material whose specific gravity is less than 3.0, it is difficult to provide a sufficient strength for the face portion 3. If the specific gravity ρ1 is less than 3.0, it is difficult to increase the moment of inertia since the mass of the head is decreased in the front part thereof. If the specific gravity ρ1 is more than 6.0, the castability becomes worse, and cast defects are liable to occur in the hosel portion and the like.

The specific gravity ρ3 of the rear member 1R is preferably not less than 6.0, more preferably not less than 7.0, still more preferably not less than 7.5, but not more than 12.0, more preferably not more than 11.5, still more preferably not more than 11.0.

If the specific gravity ρ3 is less than 6.0, when the rear member 1R is increased in the size to increase the moment of inertia, it necessitates a downsizing of the intermediate member 1M, therefore, it is difficult to obtain a mass margin. In the case of a material having a specific gravity of more than 12.0, because such material is not suitable for casting, there is a tendency that it becomes difficult to cast the rear member 1R in this example having a cup-like shape with high dimensional accuracy.

In order to increase the moment of inertia, it is necessary to decrease the mass in the neighborhood of the center of gravity G of the head and increase the mass at distant places from the center of gravity of the head.

Therefore, the specific gravity ρ2 of the intermediate member 1M is preferably not less than 1.0, more preferably not less than 1.2, still more preferably not less than 1.5, but not more than 4.0, more preferably not more than 3.5, still more preferably not more than 3.0.

In the case of a material having a specific gravity of less than 1.2, there is a possibility that the material is easily broken when undergoing a large impulsive force at the time of hitting a ball or contacting with the ground, or when colliding with another golf club head. If the specific gravity ρ3 is more than 4.0, the mass is increased, and it becomes difficult to obtain a mass margin as explained above.

Specific Gravity Ratios

The ratio (ρ1/ρ2) of the specific gravity ρ1 of the front member 1F to the specific gravity ρ2 of the intermediate member 1M is preferably not less than 1.2, more preferably not less than 1.5, still more preferably not less than 2.0, but not more than 4.0, more preferably not more than 3.5, still more preferably not more than 3.0.

If the ratio (ρ1/ρ2) is less than 1.2, as the difference in the specific gravity between the front member 1F and intermediate member 1M becomes small, it becomes difficult to obtain a mass margin from the intermediate member 1M, and the moment of inertia can not be effectively increased. If the ratio (ρ1/ρ2) is more than 4.0, there is a possibility that the depth of the center of gravity of the head from the face portion is decreased.

As the front member 1F includes the face portion 3 and hosel portion 7, it has a relatively large size. Accordingly, in order to make the intermediate member 1M sufficiently large sized to obtain a large mass margin, it is preferred to make the rear member 1R small-sized. In this light, the ratio (ρ3/ρ1) of the specific gravity ρ3 of the rear member 1R to the specific gravity ρ1 of the front member 1F is preferably not less than 1.2, more preferably not less than 1.4, still more preferably not less than 1.6.

However, if the ratio (ρ3/ρ1) becomes excessively large, then the difference in the specific gravity from the intermediate member 1M becomes vary large, therefore, stress concentrates in the lap-jointed part and damage is liable to occur. In this light, the ratio (ρ3/ρ1) is preferably not more than 3.5, more preferably not more than 3.0, still more preferably not more than 2.5.

The ratio (ρ3/ρ2) of the specific gravity ρ3 of the rear member 1R to the specific gravity ρ2 of the intermediate member 1M is preferably not less than 2.0, more preferably not less than 2.5, still more preferably not less than 3.0.

If the ratio (ρ3/ρ2) is less than 2.0, there is a tendency that the flexibility of designing the head is decreased, and the moment of inertia can not be increased sufficiently. If the ratio (ρ3/ρ2) is excessively increased, then the difference in the specific gravity from the intermediate member 1M becomes very large, therefore, a stress concentrates in the lap-jointed part and damage is liable to occur. In this light, the ratio (ρ3/ρ2) is preferably not more than 8.0, more preferably not more than 7.0, still more preferably not more than 6.0.

Materials of Members 1F, 1M and 1R

As to the material of the front member 1F, in order to satisfy the above-mentioned relationship (1) while maintaining the above-mentioned preferable head volume, metal materials, especially titanium alloys are suitably used because durability necessary for the face portion 3 and hosel portion 7 can be provided. In the case of titanium alloys, those suitable for casting, for example, Ti-6Al-4V, Ti-8Al-1V-1Mo, Ti-8Al-2V and the like are preferably used.

As to the material of the rear member 1R, metal materials having a great specific gravity such as stainless steels (e.g. SUS630) and tungsten alloys (e.g. W—Ni) are preferably used because they are suitable for casting, and although the rear member 1R has a relatively complex shape, it can be formed easily by casting.

By employing a casting method, a complicating thickness distribution can be provided for the rear member 1R easily, and thus, the flexibility of designing the head is increased. Further, it may be possible to reduce the production cost of the rear member 1R.

As to the material of the intermediate member 1M, materials having a low specific gravity such as fiber reinforced resins or plastics (FRP), magnesium alloys and aluminum alloys, and so on are used. In this embodiment, a carbon fiber reinforced resin (CFRP) is used.

In the case that the intermediate member 1M is made of a fiber reinforced resin, the front member 1F is made of a metal material and the rear member 1R is made of a metal material as in this embodiment, the member 1M is fixed to the members 1F and 1R by the use of an adhesive agent.

In the case that the intermediate member 1M is made of a metal material, for example a magnesium alloy or the like, aside from an adhesive agent, soldering and welding can be used where appropriate.

Overlap Joints 15 and 16

The inside overlapping part 11 of the front member 1F overlaps with the intermediate member 1M in at least a part of the crown portion 4 and at least a part of the sole portion 5 so as to form a front-side overlap joint 15 between the front member 1F and intermediate member 1M.

In this embodiment, the front-side overlap joint 15 is formed along the entire length of the edge of the front opening 13 of the intermediate member 1M.

The inside overlapping part 12 of the rear member 1R overlaps with the intermediate member 1M in at least a part of the crown portion 4 and at least a part of the sole portion 5 so as to form a rear-side overlap joint 16 between the front member 1F and intermediate member 1M.

In this embodiment, the rear-side overlap joint 16 is formed along the entire length of the edge of the rear opening 14 of the intermediate member 1M.

The intermediate member 1M is fixed to the inside overlapping parts 11 and 12 by the use of an adhesive agent.

The width of the inside overlapping part 11 and the width of the inside overlapping part 12, which basically correspond to the overlap widths W, are preferably set in a range of not less than 3.0 mm, more preferably not less than 5.0 mm, still more preferably not less than 7.0 mm, but not more than 15.0 mm, more preferably not more than 12.0 mm, still more preferably not more than 10.5 mm.

Here, the overlap width W is measured perpendicularly to the edge (front edge, rear edge) of the opening of the intermediate member 1M.

It is possible that the overlap width W of the front-side overlap joint 15 is substantially constant, and the overlap width W of the rear-side overlap joint 16 is substantially constant. But, it is preferable that the overlap widths W are varied.

In this embodiment, the overlap width W of the front-side overlap joint 15 is substantially constant in the crown portion 4, and the overlap width W of the front-side overlap joint 15 is substantially constant in the sole portion 5 but larger than that in the in the crown portion 4.

The overlap width W of the rear-side overlap joint 16 is substantially constant in the crown portion 4, and the overlap width W of the rear-side overlap joint 16 is substantially constant in the sole portion 5 but larger than that in the in the crown portion 4.

In the sidewall portion 6, the overlap width W of the front-side overlap joint 15 and/or the overlap width W of the rear-side overlap joint 16 are gradually increased downward.

Average Overlap Widths

In any case, the average AW of the overlap width W in each portion (4, 5, 6) is preferably set as follows.

The sole-side average overlap width AWs which is obtained by averaging the overlap width W of the front-side overlap joint 15 and the overlap width W of the rear-side overlap joint 16 in the sole portion 5, is more than the crown-side average overlap width AWc which is obtained by averaging the overlap width W of the front-side overlap joint 15 and the overlap width W of the rear-side overlap joint 16 in the crown portion 4.

Therefore, as the widths of the inside overlapping parts 11 and 12 are increased in the sole portion 5, the amount of the metal materials is relatively increased in the sole portion 5, and the center of gravity is lowered. Further, the rigidity of the sole portion 5 is increased, and the joint strength and the durability of the club head are increased. Furthermore, the ball hitting sound can be improved.

The crown-side average overlap width AWc is preferably set in a range of not less than 2 mm, more preferably not less than 5 mm, still more preferably not less than 10 mm, but not more than 25 mm, more preferably not more than 20 mm, still more preferably not more than 17 mm.

If the width AWc is less than 2 mm, the joint strength decreases. If the width AWc is more than 25 mm, the center of gravity G of the head becomes high, and it becomes difficult to increase the moment of inertia.

The sole-side average overlap width AWs is preferably set in a range of not less than 5 mm, more preferably not less than 8 mm, still more preferably not less than 12 mm, but not more than 30 mm, more preferably not more than 25 mm, still more preferably not more than 22 mm.

If the width AWs is less than 5 mm, the joint strength decreases, and the ball hitting sound is lowered and thau a ball hit feeling becomes worse. If the width AWs is more than 30 mm, it becomes difficult to increase the moment of inertia.

The ratio (Wc/Ws) of the crown-side average overlap width AWc to the sole-side average overlap width AWs is preferably set in a range of not less than 0.3, more preferably not less than 0.5, still more preferably not less than 0.6, but not more than 0.95, more preferably not more than 0.93, still more preferably not more than 0.90.

In view of the joint strength, the sidewall-side average overlap width AWp which is obtained by averaging the overlap width W of the front-side overlap joint 15 and the overlap width W of the rear-side overlap joint 16 in the sidewall portion 6 on both the toe-side and heel-side, is preferably set in a range of not less than 4 mm, more preferably not less than 6 mm, still more preferably not less than 11 mm, but not more than 23 mm, more preferably not more than 20 mm, still more preferably not more than 19 mm.

It is especially preferable that, in order to further lower the center of gravity G of the head, the sidewall-side average overlap width AWp is less than the sole-side average overlap width AWs. Namely, it is preferable that the following relationship (2) is satisfied:

$$AWs > AWp \quad (2).$$

The above-mentioned average overlap width AW (AWc, AWs, AWp) is basically obtained by dividing the area of the concerned part (namely, a part of the overlap joint 15, 16) by the total length measured along a reference edge of the concerned part (namely, the edge of the front and rear opening of the intermediate member 1M).

More specifically, in the case of the crown-side average overlap width AWc, the area of the concerned part is the total area of the front-side overlap joint 15 and the rear-side overlap joint 16 residing in the crown portion 4, and the reference edge to be measured is the edge of the front opening and the edge of the rear opening of the intermediate member 1M residing in the crown portion 4.

In the case of the sole-side average overlap width AWs, the area of the concerned part is the total area of the front-side overlap joint 15 and the rear-side overlap joint 16 residing in the sole portion 5, and the reference edge to be measured is the edge of the front opening and the edge of the rear opening of the intermediate member 1M residing in the sole portion 5.

In the case of the sidewall-side average overlap width AWp, the area of the concerned part is the total area of the front-side overlap joint 15 and the rear-side overlap joint 16 residing in the sidewall portion 6 on both the toe-side and heel-side, and the reference edge to be measured is the edge of the front opening and the edge of the rear opening of the intermediate member 1M residing in the sidewall portion 6 on both the toe-side and heel-side.

If the average overlap width AW is expressed by a mathematical expression, $$AW = \Sigma\{W(i) \times L(i)\} / \Sigma L(i), \ (i = 1, 2 \ldots)$$

wherein

W(i) is the overlap width W measured at a position (i) on the edge, and

L(i) is the length of a part of the edge including the position (i) and having the width W(i).

ΣL(i) is the total length dividing the area.

Average Thicknesses AT

It is preferable that the average thickness ATs of the intermediate member 1M in the sole portion 5 is made larger than the average thickness ATc of the intermediate member 1M in the crown portion 4.

As a result, the weight of the club head upper part is reduced to lower the position of the center of gravity of the head. Further, the rigidity of the crown portion 4 is decreased, and the crown portion makes a relatively large elastic deformation at impact to thereby increase the carry distance of the ball.

The average thickness ATc of the intermediate member 1M in the crown portion 4 is preferably not less than 0.5 mm, more preferably not less than 0.6 mm, still more preferably not less than 0.7 mm, but not more than 1.5 mm, more preferably not more than 1.2 mm, still more preferably not more than 1.1 mm. If the average thickness ATc is less than 0.5 mm, the strength becomes insufficient, and there is a possibility that the durability of the club head is greatly decreased. If the average thickness ATc is more than 1.5 mm, it is difficult to reduce the weight of the crown portion 4.

The average thickness ATs of the intermediate member 1M in the sole portion 5 is preferably not less than 0.7 mm, more preferably not less than 0.8 mm, still more preferably not less than 0.9 mm, but not more than 2.0 mm, more preferably not more than 1.5 mm, still more preferably not more than 1.3 mm. If the average thickness ATs is less than 0.7 mm, the rigidity of the sole portion 5 is decreased, and there is a possibility that the durability and ball hitting sound become worse. If the average thickness ATs is more than 2.0 mm, the weight of the club head 1 is increased in its central portion, and the freedman of designing the weight distribution is decreased.

The ratio (ATc/ATs) of the average thicknesses is preferably not less than 0.30, more preferably not less than 0.50, still more preferably not less than 0.60, but not more than 0.95, more preferably not more than 0.90, still more preferably not more than 0.85.

If the ratio (ATc/ATs) is less than 0.3, there is a possibility that the strength of the intermediate member 1M in the crown portion 4 decreases. If the ratio (ATc/ATs) is more than 0.95, there is a possibility that the above explained advantageous effects can not be obtained.

The average thickness ATp of the intermediate member 1M in the sidewall portion 6 on both the toe-side and heel-side is preferably not less than 0.5 mm, more preferably not less than 0.6 mm, still more preferably not less than 0.7 mm, but not more than 1.5 mm, more preferably not more than 1.2 mm, still more preferably not more than 1.1 mm.

The above-mentioned average thickness AT (ATc, ATs, ATp) is basically obtained by dividing the volume of the concerned portion of the intermediate member by the total area of the concerned portion.

If the average thickness AT is expressed by a mathematical expression, $$AT=\{T(j)\times S(j)\}/\Sigma S(j),\ (j=1, 2 \ldots)$$

wherein,

T(j) is the thickness T of the concerned portion at a position (j), and

S(j) is the area of a part of the concerned portion including the position (j) and having the thickness T(j). ΣS(j) is the total area of the concerned portion dividing the volume.

Depths of Intermediate Member 1M

As to the depth FL of the intermediate member 1M in the front-back direction Y, it is preferable that the average depth FLc in the crown portion 4, the average depth FLs in the sole portion 5 and the average depth FLp in in the sidewall portion 6 satisfy the following relationship (3):

$$FLc>FLp>FLs \quad (3).$$

It is especially preferable that the average depth FLc in the crown portion 4 is within a range of from 70 to 100 mm, the average depth FLp in the sidewall portion 6 is within a range of from 60 to 90 mm, and the average depth FLs in the sole portion 5 is within a range of from 50 mm to 70 mm.

Figure 2:
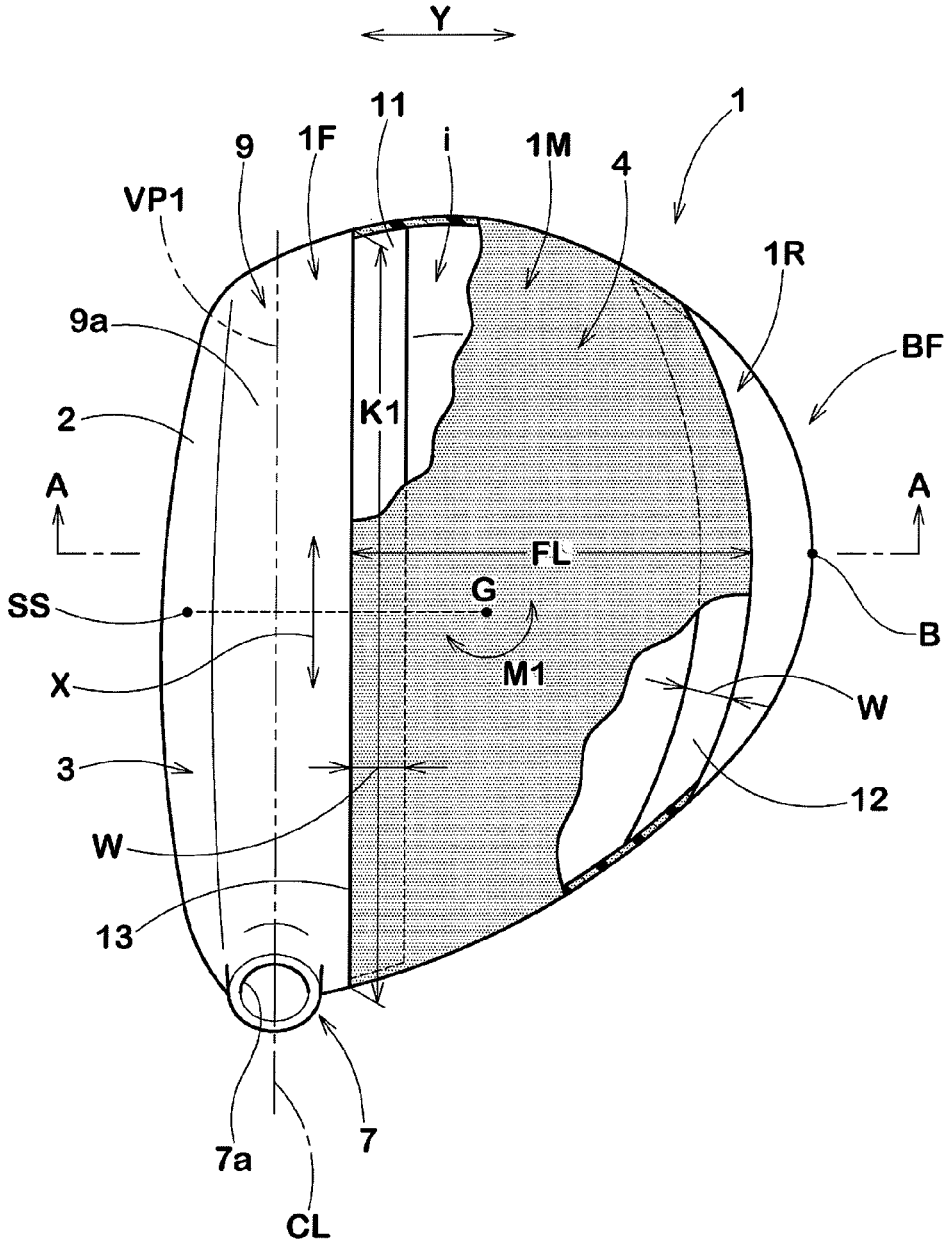
FIG. 2 is a top plan view of the golf club head.

The average depth FLc in the crown portion 4 is obtained by dividing the area of the intermediate member 1M residing in the crown portion 4 by the length K1 of the edge of the front opening 13 of the intermediate member 1M residing in the crown portion 4, both measured in the top plan view of the head as shown in FIG. 2.

Figure 3:
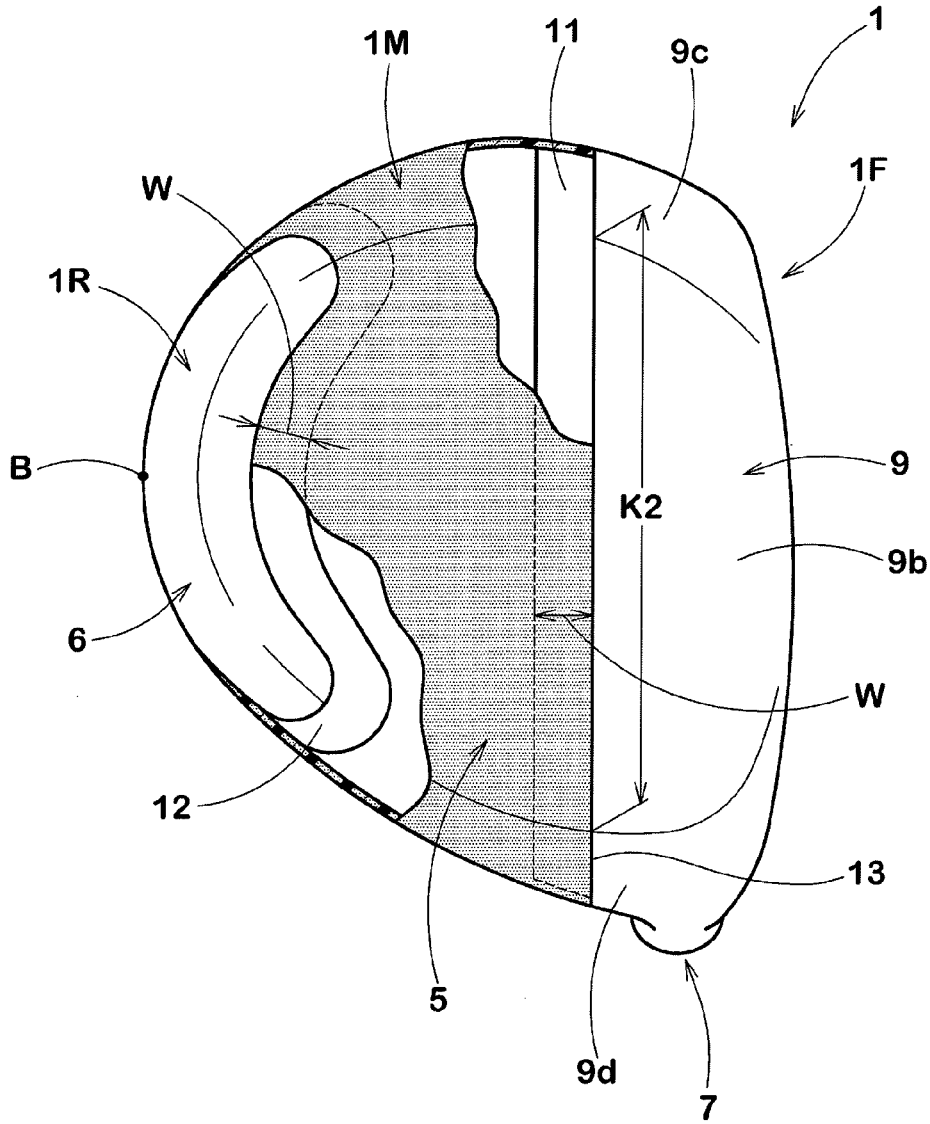
FIG. 3 is a bottom plan view of the golf club head.

The average depth FLs in the sole portion 5 is obtained by dividing the area of the intermediate member 1M residing in the sole portion 5 by the length K2 of the edge of the front opening 13 of the intermediate member 1M residing in the sole portion 5, both measured in the bottom plan view as shown in FIG. 3.

Figure 4A:
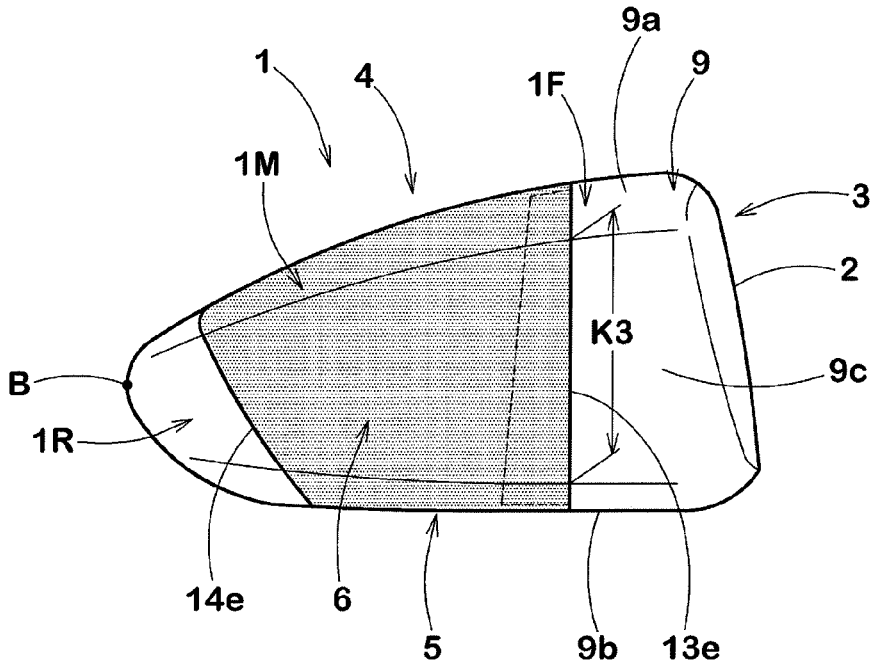
FIG. 4(*a*) is a side view of the golf club head from its toe-side.
Figure 4B:
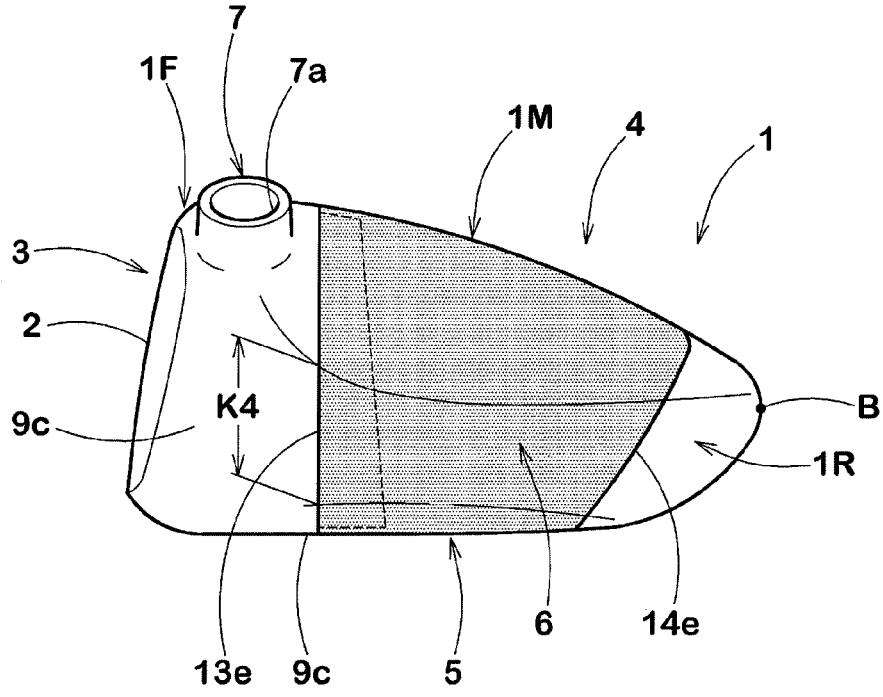

The average depth Ftp in the sidewall portion 6 is obtained by dividing the total area of the area of the intermediate member 1M residing in the sidewall portion 6 measured in the side view from the toe-side as shown in FIG. 4(*a*) and the area of the intermediate member 1M residing in the sidewall portion 6 measured in the side view from the heel-side as shown in FIG. 4(*b*)

by the total length of the length K3 of the edge of the front opening 13 of the intermediate member 1M residing in the crown portion 4 measured in the side view from the toe-side as shown in FIG. 4(*a*) and the length K4 of the edge of the front opening 13 of the intermediate member 1M residing in the crown portion 4 measured in the side view from the heel-side as shown in FIG. 4(*b*).

The boundary between the sidewall portion 6 and sole portion 5 is defined as lying at a height of 5.0 mm from the above-mentioned horizontal plane HP.

By limiting the depth of the intermediate member 1M as explained above, the mass distributed in the intermediate member 1M is decreased towards the sole portion. As a result, the mass distribution in the rear member 1R can be increased, and the position of the center of gravity can be further lowered. Further, as the average depth FLs in the crown portion 4 is the largest, the intermediate member 1M of the fiber reinforced resin makes a relatively large elastic deformation in the crown portion 4 when hitting a ball, and thereby the carry distance may be increased.

In order to satisfy the above-mentioned relationship (3), the following arrangement as shown in FIGS. 4(*a*) and 4(*b*) is possible, namely, the edge 13*e* of the front opening of the intermediate member 1M is substantially on a plane which is substantially vertical and substantially parallel to the toe-heel direction, but the edge 14*e* of the rear opening of the intermediate member 1M is on a plane which is inclined forward from the crown portion 4 side towards the sole portion 5 side.

Thereby, the mass of the rear member 1R shifts downwards as well as backwards, therefore, the center of gravity is further lowered.

Preferably, the ratio (FLc/FLp) of the average depths is not less than 1.10, more preferably not less than 1.15, still more preferably not less than 1.20, but not more than 1.70, more preferably not more than 1.50, still more preferably not more than 1.40.

If the ratio (FLc/FLp) is less than 1.10, it is difficult to lower the center of gravity. If the ratio (FLc/FLp) is more than 1.70, the rear member 1R becomes large, and there is a possibility that the freedom of designing the mass distribution is decreased.

Preferably, the ratio (FLc/FLs) of the average depths is not less than 1.20, more preferably not less than 1.30, still more preferably not less than 1.40, but not more than 2.00, more preferably not more than 1.80, still more preferably not more than 1.70.

In particular, if the ratio (FLc/FLs) is less than 1.20, the average depth FLs in the sole portion 5 is relatively increased, and there is a possibility that the ball hitting sound becomes worse.

Preferably, the ratio (FLp/FLs) of the average depths is not less than 1.10, more preferably not less than 1.13, still more preferably not less than 1.15, but not more than 1.70, more preferably not more than 1.60, still more preferably not more than 1.40.

since the club head 1 is provided with the construction as stated, although the head volume is limited to comply with the Golf Rules, the lateral moment of inertia M1 can be increased to 5000 g sq.cm or more. In general, there is a tendency that the ball hitting positions are varied largely from the sweet spot SS towards the toe or heel, therefore, it is especially preferable that the lateral moment of inertia M1 is set to be not less than 5200 g sq.cm, more preferably not less than 5300 g sq.cm. However, if the lateral moment of inertia M1 is too large, there is a possibility that the club head weight is increased excessively, and the shape of the club head becomes unusual. Therefore, it is preferable that the lateral moment of inertia M1 is set to be not more than 5900 g sq.cm.

In this embodiment, since the club head 1 has the construction as stated, although the head volume is limited to comply with the Golf Rules, the vertical moment of inertia M2 can be set in a range of from 3000 to 4500 g sq.cm. such a large vertical moment of inertia M2 can decrease the variations of the ballistic courses when the ball hitting positions are shifted upward or downward from the sweet spot.

Comparison Tests

Golf club heads for #1 driver having a volume of 460 cc, mass of 195 g, lie angle of 58.0 degrees and loft angle of 11.5 degrees were made in compliance with the R&A Golf Rules and tested as follows.

The front members were each formed by assembling two parts: a face plate 1Fa and an annular frame 1Fb as explained. As shown in FIG. 5, the annular frame 1Fb was formed by casting a titanium alloy Ti-6Al-4V (lost-wax precision casting). The face plate 1Fa was formed by press-molding a rolled titanium alloy Ti-6Al-4V. The face plate 1Fa was fixed to the front of the annular frame 1Fb by plasma welding so as to close the front opening of the annular frame 1Fb.

The rear members were each formed from a metal alloy (SUS630 or W—Ni, cf. Table 1) through lost-wax precision casting process.

The intermediate members were each fixed to the front member and rear member by the use of an adhesive agent. As to the adhesive agents, an epoxy adhesive "EW2010" manufactured by SUMITOMO-3M Ltd. was used in Ex.5, and an epoxy adhesive "DP420" manufactured by SUMITOMO-3M Ltd. was used in all the rest.

Intermediate member (a) was made from a carbon fiber reinforced resin (CFRP). Prepregs of the CFRP were applied to a core in an annular shape and thermal hardened.

Intermediate member (b) was formed by casting a magnesium alloy.

The specifications of the front, rear and intermediate members are shown in Table 1.

Measurement of Moment of Inertia:

Each of the club heads was measured for the lateral moment of inertia and vertical moment of inertia, using an measuring instrument (Model No. 005-002) manufactured by INERTIA DYNAMICS Inc.

Measurement of Average Carry Distance

The club heads were attached to identical FRP shafts (MP400, Flex R, manufactured by SRI Sports Limited) to make #1 wood clubs.

Each of the clubs was attached to a golf swing robot, and hit three-piece balls at a head speed of 40 meter/second five times at each of three hitting positions (the sweet spot SS, a position 20 mm toe-side from SS and a position 20 mm heel-side from SS), and the carry distance of the ball was measured to obtain an average carry distance at each of the hitting positions. The obtained results are shown in Table 1.

Measurement of Variation of Carry Distance

Using each of the clubs, ten golfers having handicaps ranging from 10 to 20 hit the golf balls ten times per person, and the difference between the maximum carry distance and the minimum carry distance marked by each golfer was measured. The average of the ten values of the difference of the ten golfers for each of the clubs were obtained. The results are shown in Table 1, wherein the smaller value is better in view of the variation of carry distance.

From the test results, it was confirmed that according to the invention, the moment of inertia is increased, and the variations of traveling distance can be decreased.

TABLE 1

| Head | Ex.1 | Ex.2 | Ex.3 | Ex.4 | Ex.5 | Ex.6 | Ref.1 | Ref.2 |
|---|---|---|---|---|---|---|---|---|
| Material *1 | | | | | | | | |
| Front | TiAlV | TiAlV | TiAlV | TiAlV | TiAlV | TiAlV | TiAlV | Integral molding of TiAlV |
| Intermediate | CFRP | CFRP | CFRP | CFRP | Mg(AZ91) | CFRP | CFRP | |
| Rear | SUS630 | SUS630 | W—Ni | W—Ni | W—Ni | SUS630 | TiAlV | |
| Specific gravity | | | | | | | | 4.42 |
| ρ1 (front) | 4.42 | 4.42 | 4.42 | 4.42 | 4.42 | 4.42 | 4.42 | — |
| ρ2 (intermediate) | 1.80 | 1.80 | 1.80 | 1.80 | 1.81 | 1.80 | 1.80 | — |
| ρ3 (rear) | 7.80 | 7.80 | 9.50 | 9.50 | 9.50 | 7.80 | 4.42 | — |
| ρ1/ρ2 | 2.46 | 2.46 | 2.46 | 2.46 | 2.44 | 2.46 | 2.46 | — |

TABLE 1-continued

| Head | Ex.1 | Ex.2 | Ex.3 | Ex.4 | Ex.5 | Ex.6 | Ref.1 | Ref.2 |
|---|---|---|---|---|---|---|---|---|
| ρ3/ρ2 | 4.33 | 4.33 | 5.28 | 5.28 | 5.25 | 4.33 | 2.46 | — |
| ρ3/ρ1 | 1.76 | 1.76 | 2.15 | 2.15 | 2.15 | 1.76 | 1.00 | — |
| Average overlap width | | | | | | | | |
| AWc (crown) (mm) | 15.0 | 13.0 | 14.0 | 12.0 | 16.0 | 16.0 | 14.0 | — |
| AWp (sidewall) (mm) | 17.0 | 14.3 | 15.5 | 13.0 | 17.5 | 16.0 | 16.5 | — |
| AWs (sole) (mm) | 18.0 | 16.0 | 16.6 | 14.0 | 20.0 | 16.0 | 18.0 | — |
| AWc/AWs | 0.83 | 0.81 | 0.84 | 0.86 | 0.80 | 1.00 | 0.78 | — |
| Average depth | | | | | | | | |
| FLc (crown) (mm) | 85.0 | 90.0 | 85.0 | 96.0 | 85.0 | 50.0 | 85.0 | — |
| FLp (sidewall) (mm) | 64.8 | 73.2 | 64.8 | 76.8 | 64.8 | 50.0 | 64.8 | — |
| FLs (sole) (mm) | 54.9 | 54.2 | 54.9 | 60.5 | 54.9 | 50.0 | 54.9 | — |
| FLc/FLp | 1.31 | 1.23 | 1.31 | 1.25 | 1.31 | 1 | 1.31 | — |
| FLc/FLs | 1.55 | 1.66 | 1.55 | 1.59 | 1.55 | 1 | 1.55 | — |
| FLp/FLs | 1.18 | 1.35 | 1.18 | 1.27 | 1.18 | 1 | 1.18 | — |
| Average thickness | | | | | | | | |
| ATc (crown) (mm) | 0.80 | 0.80 | 0.75 | 0.75 | 1.10 | 1.00 | 0.80 | — |
| ATp (sidewall) (mm) | 0.80 | 0.80 | 0.75 | 0.75 | 1.10 | 1.00 | 0.80 | — |
| ATs (sole) (mm) | 1.00 | 1.18 | 1.07 | 1.00 | 1.29 | 1.00 | 1.07 | — |
| ATc/ATs | 0.80 | 0.68 | 0.70 | 0.75 | 0.85 | 1.00 | 0.75 | — |
| Moment M1 (g sq · cm) | 5420 | 5640 | 5705 | 5810 | 5380 | 5185 | 5065 | 4830 |
| Moment M2 (g sq · cm) | 3430 | 3540 | 3855 | 4075 | 3535 | 3220 | 3150 | 2760 |
| Av. carry distance (yard) | | | | | | | | |
| sweet spot | 217.1 | 218.2 | 218.5 | 218.4 | 216.4 | 215.1 | 214.6 | 213.5 |
| 20 mm toe-side | 212.7 | 214.0 | 214.7 | 215.5 | 210.3 | 209.7 | 208.6 | 207.6 |
| 20 mm heel-side | 208.3 | 210.7 | 213.2 | 213.8 | 206.9 | 205.0 | 203.3 | 200.3 |
| Max. – Min. | 8.8 | 7.5 | 5.3 | 4.6 | 9.5 | 10.1 | 11.3 | 13.2 |
| Variation of carry distances (yard) | 16.1 | 14.5 | 12.1 | 11.4 | 15.7 | 17.1 | 17.7 | 18.5 |

*1) TiAlV = Ti—6Al—4V

The invention claimed is:

1. A golf club head having a hollow structure comprising a front member including a face portion and a hosel portion of the club head, a rear member forming a backmost point of the club head, and an intermediate member disposed therebetween and extending annularly through a crown portion, a sole portion and a sidewall portion therebetween, wherein the front member and the intermediate member are overlapped with each other in the crown portion and the sole portion, forming a front-side overlap joint, and the rear member and the intermediate member are overlapped with each other in the crown portion and the sole portion, forming a rear-side overlap joint; and wherein the front member is made of a material having a specific gravity ρ1, the intermediate member is made of a material having a specific gravity ρ2, the rear member is made of a material having a specific gravity ρ3, and the specific gravity ρ3 is more than the specific gravity ρ1 which is more than the specific gravity ρ2; and wherein a sole-side average overlap width AWs obtained by averaging the width of the front-side overlap joint and the width of the rear-side overlap joint in the sole portion is more than a crown-side average overlap width AWc obtained by averaging the width of the front-side overlap joint and the width of the rear-side overlap joint in the crown portion.

2. The golf club head according to claim 1, wherein the ratio (Wc/Ws) of the crown-side average overlap width AWc to the sole-side average overlap width AWs is not less than 0.3 and not more than 0.95.

3. The golf club head according to claim 1, wherein an average thickness of the intermediate member in the sole portion is more than an average thickness of the intermediate member in the crown portion.

4. The golf club head according to claim 1, 2, or 3 wherein, measured in the front-back direction, an average depth FLc of the intermediate member in the crown portion is more than an average depth FLs of the intermediate member in the sole portion.

5. The golf club head according to claim 1, 2, or 3 wherein, measured in the front-back direction, an average depth FLc of the intermediate member in the crown portion is more than an average depth FLp of the intermediate member in the sidewall portion which is more than an average depth FLs of the intermediate member in the sole portion.

6. The golf club head according to claim 1, wherein the front member is made of a titanium alloy, the intermediate member is made of a fiber reinforced resin or a magnesium alloy or an aluminum alloy, and the rear member is made of a stainless steel or a tungsten alloy.

7. The golf club head according to claim 1, which has a loft angle of not less than 8.0 degrees and not more than 17.0 degrees.

8. The golf club head according to claim 1, which has a head volume of not less than 400 cc and not more than 470 cc.

9. The golf club head according to claim 1, which has a mass of not less than 175 g and not more than 210 g.

10. The golf club head according to claim 1, wherein the specific gravity ρ1 of the front member is not less than 3.0 and not more than 6.0, the specific gravity ρ2 of the intermediate member is not less than 1.0 and not more than 4.0, and the specific gravity ρ3 of the rear member is not less than 6.0 and not more than 12.0.

11. The golf club head according to claim 1, wherein the ratio (ρ1/ρ2) of the specific gravity ρ1 to the specific gravity ρ2 is not less than 1.2 and not more than 4.0, the ratio (ρ3/ρ1) of the specific gravity ρ3 to the specific gravity ρ1 is not less than 1.2 and not more than 3.5, and the ratio (ρ3/ρ2) of the specific gravity ρ3 to the specific gravity ρ2 is not less than 2.0 and not more than 8.0.

12. The golf club head according to claim 1, wherein the intermediate member has a surface area of not less than 50% and not more than 75% of the overall surface area of the club head.

13. The golf club head according to claim 1, wherein the edge of the front opening of the intermediate member is on a plane.

14. The golf club head according to claim 13, wherein said plane is substantially vertical and substantially parallel to the toe-heel direction.

15. The golf club head according to claim 1, wherein the edge of the rear opening of the intermediate member is on a plane.

16. The golf club head according to claim 15, wherein said plane is declined forward from the crown portion side towards the sole portion side.

* * * * *